United States Patent [19]

Grant

[11] Patent Number: 4,787,624

[45] Date of Patent: Nov. 29, 1988

[54] JUMP ROPE ATTACHMENT FOR HANDWEIGHTS

[76] Inventor: Jerry A. Grant, 3200 Leesburg Rd., Columbia, S.C. 29209

[21] Appl. No.: 923,037

[22] Filed: Oct. 24, 1986

[51] Int. Cl.[4] ..... A63B 5/20

[52] U.S. Cl. ..... 272/75; 272/122

[58] Field of Search ..... 272/75, 122, 74, 68, 272/117, 118

[56] References Cited

U.S. PATENT DOCUMENTS

| | | | |
|---|---|---|---|
| 2,719,038 | 9/1955 | Massa | 272/75 |
| 4,018,441 | 4/1977 | Greenberg | 272/75 |
| 4,079,932 | 3/1978 | Schuetz | 272/75 |
| 4,157,827 | 6/1979 | Winston et al. | 272/75 |
| 4,351,526 | 9/1982 | Schwartz | 272/122 |
| 4,566,690 | 1/1986 | Schook | 272/123 |
| 4,627,618 | 12/1986 | Schwartz | 272/122 |
| 4,647,037 | 3/1987 | Donohue | 272/75 |

FOREIGN PATENT DOCUMENTS

| | | | |
|---|---|---|---|
| 1164490 | 3/1984 | Canada | 272/74 |

*Primary Examiner*—Carl D. Friedman
*Assistant Examiner*—Caroline D. Dennison
*Attorney, Agent, or Firm*—Benoni O. Reynolds

[57] ABSTRACT

An apparatus for attaching a jump rope to a pair of handweights which has a C-shaped adapter which accommodates the full range of detachable weights normally used with aerobic handweights such as the "Heavy Hands" handweights of AMF Industries. The C-shaped adapter slips over the threaded extension on one end of each handweight and is held in place by the detachable weight after it is screwed down over the threaded extension. The C-shaped adapter has an upper portion in which a pressed fit bearing accommodates and retains one extreme end of the jump rope and has a lower portion having a circular opening for slidably attaching each C-shaped adapter to one of the respective handweights. A middle portion of the C-shaped adapter holds the upper and lower portions of the C-shaped adapter in a parallel relationship to one another and the dimensions of the C-shaped adapter are such that its three portions clear the depth and diameter of each of the range of detachable weights. Retainer clips on either end of the jump rope hold it within the C-shaped adapter and a resilient washer, permanently affixed to the inside of the lower portion of the C-shaped adapter, assure a tight fit for the detachable weight.

5 Claims, 1 Drawing Sheet

JUMP ROPE ATTACHMENT FOR HANDWEIGHTS

BACKGROUND OF THE INVENTION (1) Field of Invention

This invention relates generally to jump ropes used in exercise and ore particularly to apparatus for attaching a jump rope to a pair of aerobic handweights having a range of detachable weights.

(2) Description of Prior Art

Jump or skipping ropes have long been utilized by athletes and others as an excellent means of training for endurance and increasing the efficient use of oxygen by the body. Also, it is well known in the prior art that the use of weights, such as handweights, during aerobic exercise has additional positive training value in strengthening the muscles in the arms and chest. The use of handweights Jointly with a jumping rope would therefore bring a beneficial combination to one who participates regularly in aerobic exercises using separate apparatus.

Various forms of apparatus seeking to accomplish the same purpose have been disclosed in the prior art. However, these devices, for the most part, have been bulky, awkward to use and sometimes interfered with the natural motion of the aerobic exercise. Also, none of the prior devices allowed for easily changing the amount of weight to a precisely different amount. One method used a standard jump rope handle to which a weight was attached at the bottom of the handle. A second method had a hollow shell and handle device to which water or sand could be introduced to create the weighted effect. Another method used weighted gloves to which the jump rope was attached. All of these methods suffered from one or more of the drawbacks noted above.

It is believed that the present invention is the only apparatus which attaches a jump rope to handweights having a range of detachable weights such as the "Heavy Hands" marketed by AMF Industries, Inc. The present invention is easy to use, provides for quick changes to different weights and is far less bulky than the apparatus for the same purpose found in the prior art. Prior art known to this inventor includes the following U.S. Patent Numbers:

| | | |
|---|---|---|
| 2,719,038 | 9/1955 | Massa |
| 4,018,441 | 4/1977 | Greenberg |
| 4,079,932 | 3/1978 | Schuetz |
| 4,351,526 | 9/1982 | Schwartz |
| 4,566,690 | 1/1986 | Schook |

SUMMARY OF THE INVENTION

The present invention is a jump rope apparatus for use with a pair of aerobic handweights having a range of detachable weights.

According to the preferred embodiment, the apparatus comprises a jump rope, connector means for attaching the apparatus to the handweights, and swivel means for attaching the jump rope to the connector means so that the jump rope can rotate freely in a 360 degree arc.

Connector means is two C-shaped adapters, each C-shaped adapter having an upper portion, housing the swivel means, and a lower portion, having a circular opening for slidably attaching the C-shaped adapter to one of the aerobic handweights. Each C-shaped adapter also has a middle portion, for holding the upper portion and the lower portion of the C-shaped adapter in a parallel relationship to one another.

Preferably the upper portion and the lower portion of the C-shaped adapter are spaced apart between 1 and 4 inches from one another and the middle portion of the C-shaped adapter is located between 1 inch and 4 inches from the center of the circular opening in the lower portion of the C-shaped adapter. A resilient washer is permanently attached to the inside of the lower portion of the C-shaped adapter, encircling the circular opening, to assure a tight fit for the full range of detachable weights.

Swivel means is a pressed fit bearing, in the upper portion of the C-shaped adapter, which bearing has an opening to accommodate and retain therein one extreme end of the jump rope. The extreme ends of the jump rope are retained within the pressed fit bearing by circular retaining clips.

As the present invention is specifically designed for use with the "Heavy Hands" handweights manufactured and marketed by AMF Industries, the apparatus illustrated can accommodate the full range of weights presently available for the "Heavy Hands" handweights. To attach the apparatus, you need only (1) detach the weight fastened on one of the threaded extensions of each handweight, (2) slip the circular opening of the lower portion of the C-shaped adapter over the threaded extension, (3) refasten the weight, or another weight, to the exposed threaded extension and screw the weight down in place The resilient washer, which is permanently attached to the inside of the lower portion of the C-shaped adapter, assures a tight fit for the weight which holds the C-shaped adapter in place as well as serves as a weight.

The pressed fit bearing and the circular retaining clips hold the jump rope in place in the upper portion of the C-shaped adapter and permit the jump rope to travel freely through a 360 degree arc during the aerobic exercise.

OBJECTIVES OF THE INVENTION

The objectives of the present invention are to provide an apparatus for connecting a jump rope to a pair of handweights in which:

(1) the apparatus is simple in construction;

(2) the apparatus is not bulky and does not interfere with the use of the jump rope;

(3) the jump rope is centered on the handweight and has full freedom of movement through 360 degrees;

(4) various size weights can be easily interchanged without disturbing the jump rope;

(5) the apparatus can accommodate the "Heavy Hands" handweights of AMF Industries and the full range of weights supplied therewith;

Other objectives and advantages of the present invention will be apparent during the course of the following detailed description.

DETAILED DESCRIPTION OF THE PREFERRED EMBODIMENT OF THE INVENTION

Figure 1:
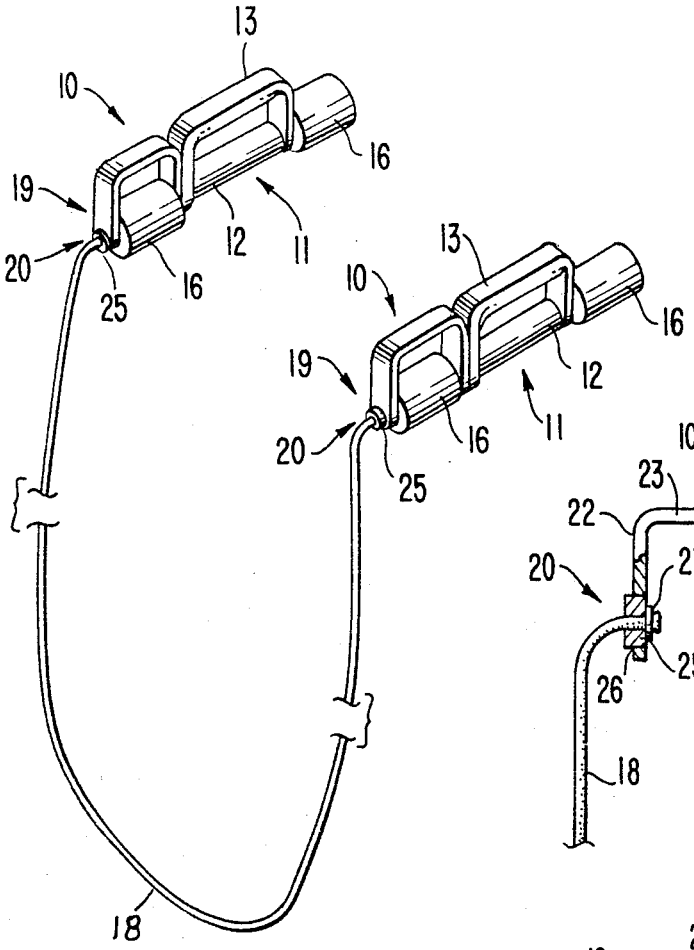
FIG. 1 is a perspective view from the right front of the jump rope apparatus constructed in accordance with the principles of the present invention, showing the manner in which it attaches to a pair of aerobic handweights.
Figure 2:
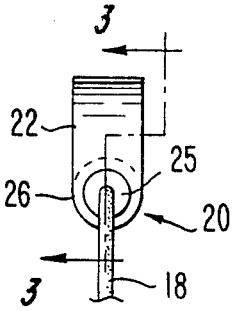
FIG. 2 is a plan view of the same present invention showing the upper portion of the C-shaped adapter which houses the pressed fit bearing.

The jump rope apparatus is a compact, relatively small unit, which is easily attached to or detached from a pair of aerobic handweights, allowing a range of detachable weights to be used without disturbing the jump rope apparatus. Throughout the following detailed description of the present invention, like reference numerals are used to denote like parts disclosed in the accompanying drawings, FIGS. 1–4.

Figure 3:
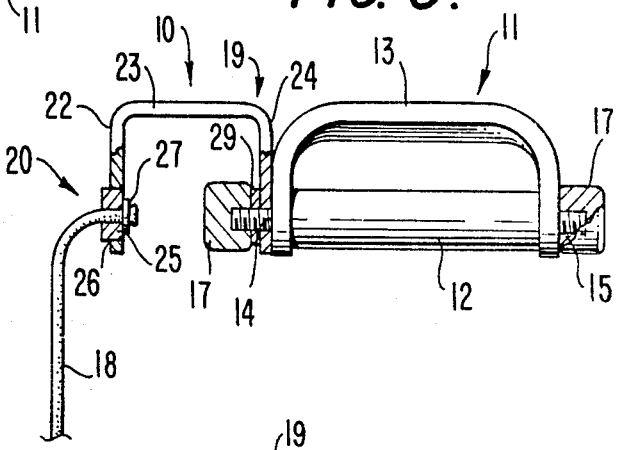
FIG. 3 is a fragmentary side elevational view of the present invention taken substantially along line 3—3 of FIG. 2 showing how the C-shaped adapter fastens between the handweight and the detachable weight.

As shown in FIG. 1, the jump rope apparatus, shown generally at reference numeral 10, is designed to attach to one end of a pair of aerobic handweights, shown generally at reference numerals 11. The basic structure of aerobic handweights usually comprises a handle 12, a retaining strap 13 and two threaded extensions 14 and 15. The handweights 11, usually each weigh about a pound and a range of additional detachable weights, such as 16 and 17, are furnished with aerobic handweights 11 to bring each such handweight up to a higher total weight. The aerobic handweight 11, shown in FIGS. 1 and 3, is typical of the most popular handweights, manufactured and marketed by AMF Industries under the trademark "Heavy Hands". At the present time AMF Industries furnishes 9 sets of extra detachable weights, each such weight increasing the weight of the handweight by a pound, the largest weights bringing the total weight of the handweight to 10 pounds. The detachable weights, such as 16 and 17, screw onto threaded extensions 14 and 15 shown on both ends of handweight 11 in FIG. 3.

The Jump rope apparatus of the present invention is for use with a pair of aerobic handweights, such as described above, which have a range of detachable weights. The jump rope apparatus comprises a jump rope 18, preferably made of ¼ inch top grain leather cord or waterproof nylon, and a connector means, shown generally at reference numeral 19, for attaching jump rope apparatus 10 to aerobic handweights 11. Jump rope apparatus 10 also has a swivel means, shown generally at reference numeral 20 for attaching jump rope 18 to connector means 19 so that jump rope 18 can rotate freely in a b 360 degree arc.

Figure 4:
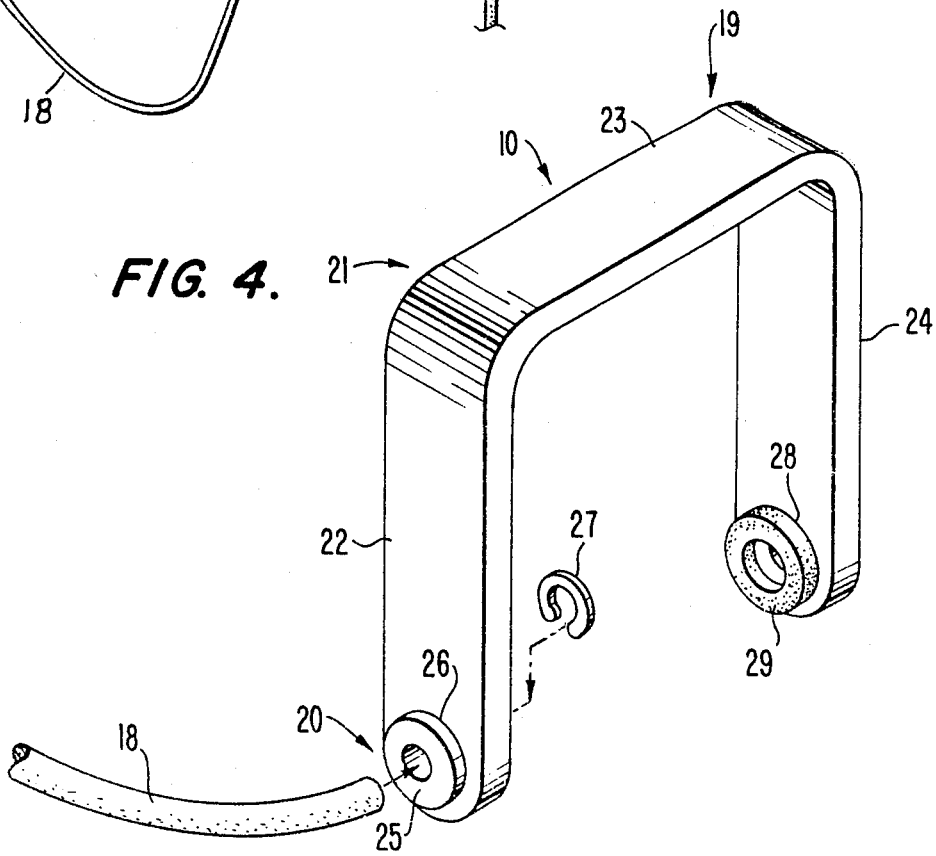
FIG. 4 is a perspective view of the present invention showing the relationship of the top portion, middle portion and lower portion.

As best shown in FIG. 4, connector means 19 is two C-shaped adapters, such as the one shown generally at reference numeral 21, each C-shaped adapter 21 having an upper portion 22, a middle portion 23 and a lower portion 24. Preferably, C-shaped adapter 21 is made of 3/16 inch strap iron, 1¼ inches wide, molded in a C-shape as shown in FIG. 4. The bends and ends are rounded for safety and aesthetic reasons.

Upper portion 22 houses swivel means 20. Swivel means 20 is a pressed fit bearing 25 in upper portion 22 of C-shaped adapter 21 which bearing has an opening 26, to accommodate and retain therein one extreme end of jump rope 18. Ideally this hole is 13/16 inch in diameter to accommodate an American Pressed Fit roller bearing, Number 608. The extreme ends of jump rope 18 are retained within pressed fit bearing 25 by circular retaining clips 27 which are preferably made of steel.

Lower portion 24 has a circular opening 28, ideally 13/16 inch in diameter, for slidably attaching C-shaped adapter 21 to one of the aerobic handweights 11. A resilient washer 29, preferably made of vinyl or rubber, is permanently attached to the inside of lower portion 24 of C-shaped adapter 21, encircling circular opening 28, to assure a tight fit for the range of detachable weights, such as 16 and 17, when these weights are screwed into place. To attach jump rope apparatus 10 of the present invention, the user need only (1) detach the weight, such as 16 and 17, fastened on one end of the threaded extensions 14 or 15 of each handweight 11, (2) slip circular opening 28 of lower portion 24 of C-shaped adapter 21 over the threaded extension 14 or 15 of each handweight 11 so exposed, (3) refasten the detachable weight, such as 16 and 17, or another weight furnished with the handweights 11, to the exposed threaded extension 14 or 15 of each handweight 11 and screw the weight, such as 16 and 17 down in place against resilient washer 29. In this manner the weights 16 or 17 hold C-shaped adapter 21 tightly to each handweight 11 and serve as detachable weights for the aerobic exercise function as well.

Middle portion 23 holds upper portion 22 and lower portion 24 of C-shaped adapter 21 in a parallel relationship to one another, connecting jump rope 18 to handweights 11 in such a manner that the pressed fit bearing 25 is exactly centered over the end of the particular handweight 11. For the "Heavy Hands" handweights, opening 26 in upper portion 22 and circular opening 28 in lower portion 24 are centered ⅝ inch from the respective ends of C-shaped adapter 21. Further, the top surface of upper portion 22 is spaced 3 inches from the inside surface of lower portion 24 and the inside surface of middle portion 23 is spaced 2 inches from a line centered on opening 26 and circular opening 28.

Although the above described dimensions are ideal for "Heavy Hands" handweights, to cover a fuller range of handweights as well the inventor claims any C-shaped adapter 21 wherein upper portion 22 and lower portion 24 are spaced apart between 1 and 4 inches from one another and middle portion 23 of C-shaped adapter 21 is located between 1 inch and 4 inches from the center of circular opening 28 in lower portion 24 of C-shaped adapter 21.

I claim:

1. A jump rope apparatus, in combination with a pair of aerobic handweights having an elongate handle with two ends and threaded extensions protruding longitudinally from each end connectable to a full range of detachable weights, comprising:

a jump rope, two C-shaped adapters, each said C-shaped adapter having a first portion, housing a swivel means for attaching said jump rope so that said jump rope can rotate freely in a 360 degree arc, and a second portion, having a circular opening for slidably attaching a threaded extension of one of said aerobic handweights, and a middle portion, for holding said first portion and said second portion of said C-shaped adapter in a parallel relationship to one another, whereby said detachably weights can be located between said first and second portions of said C-shaped adapter.

2. The jump rope apparatus of claim 1 wherein swivel means is a pressed fit bearing in said first portion of said C-shaped adapter which said bearing has an opening to accommodate and retain therein one extreme end of said jump rope.

3. The jump rope apparatus of claim 1 wherein said first portion and said second portion of said C-shaped adapter are spaced apart between 1 and 4 inches from one another and said middle portion of said C-shaped adapter is located between 1 inch and 4 inches from the center of said circular opening in said second portion of said C-shaped adapter.

4. The jump rope apparatus of claim 2 wherein the extreme ends of said jump rope are retained within said pressed fit bearing by circular retaining clips.

5. The jump rope apparatus of claim 2 wherein a resilient washer is permanently attached to the inside of said second portion of said C-shaped adapter, encircling said circular opening, to assure a tight fit for the full range of detachable weights.

* * * * *